US008024907B2

(12) United States Patent
McKinlay et al.

(10) Patent No.: US 8,024,907 B2
(45) Date of Patent: Sep. 27, 2011

(54) INSULATED PANELS

(75) Inventors: Ross Campbell McKinlay, Queensland (AU); Murray Christian Pickford, Queensland (AU)

(73) Assignee: Julian McKinlay King (AU)

( * ) Notice: Subject to any disclaimer, the term of this patent is extended or adjusted under 35 U.S.C. 154(b) by 833 days.

(21) Appl. No.: 10/595,144

(22) PCT Filed: Sep. 3, 2004

(86) PCT No.: PCT/AU2004/001191

§ 371 (c)(1),
(2), (4) Date: Mar. 3, 2006

(87) PCT Pub. No.: WO2005/021886

PCT Pub. Date: Mar. 10, 2005

(65) Prior Publication Data

US 2006/0260229 A1 Nov. 23, 2006

(30) Foreign Application Priority Data

Sep. 3, 2003 (AU) ..... 2003904771
Dec. 31, 2003 (AU) ..... 2003907213

(51) Int. Cl.
*E06B 7/00* (2006.01)
*E06B 7/12* (2006.01)

(52) U.S. Cl. ..... 52/786.1; 52/745.15; 52/204.593; 49/504

(58) Field of Classification Search ..... 52/786.1, 52/786.11, 745.15, 204.5, 204.593, 204.6; 49/501, 504; 62/246; 312/116, 138.1, 139.2
See application file for complete search history.

(56) References Cited

U.S. PATENT DOCUMENTS 2,525,717 A * 10/1950 Ottenheimer ..... 52/172
2,861,398 A * 11/1958 Woods ..... 65/58
3,875,706 A * 4/1975 Okawa ..... 52/172
4,004,370 A 1/1977 Heaney
4,563,843 A * 1/1986 Grether et al. ..... 52/172
4,604,840 A * 8/1986 Mondon ..... 52/172
(Continued)

FOREIGN PATENT DOCUMENTS

CA 2164346 A1 6/1997
(Continued)

OTHER PUBLICATIONS

Machine Translation corresponding to JP 2146488.
(Continued)

*Primary Examiner* — Khoi Tran
*Assistant Examiner* — Jason Holloway
(74) *Attorney, Agent, or Firm* — Brooks Kushman P.C.

(57) ABSTRACT

A panel comprising: a frame member (70) defining a periphery of said panel; a first wall (77) retained by the frame (70) and a second wall (79) opposing said first wall (77) and together with the first wall (77) defining an internal space (73, 74) of the panel; the panel further comprising at least one intermediate wall (78) disposed in said internal space intermediate the first (77) and second walls (79) and which creates a first space (73) in said internal space between said intermediate wall (78) and said first wall (77) and a second space (74) in said internal space between said intermediate wall (78) and said second wall (79); characterized in that the frame includes respective abutment surfaces (80, 81, 82) which receive and retain respective first, second and intermediate walls wherein; the intermediate wall (78) insulates said first wall (77) from said second wall (79).

17 Claims, 8 Drawing Sheets

U.S. PATENT DOCUMENTS

| | | | | |
|---|---|---|---|---|
| 5,097,642 | A * | 3/1992 | Richardson et al. | 52/171.3 |
| 5,111,618 | A | 5/1992 | Kaspar et al. | |
| 5,113,628 | A * | 5/1992 | Richardson et al. | 52/171.3 |
| 5,255,473 | A * | 10/1993 | Kaspar et al. | 49/501 |
| 5,512,341 | A * | 4/1996 | Newby et al. | 428/35.8 |
| 5,653,073 | A * | 8/1997 | Palmer | 52/204.593 |
| 5,910,083 | A * | 6/1999 | Richardson et al. | 52/171.1 |
| 5,983,593 | A * | 11/1999 | Carbary et al. | 52/786.11 |
| 6,029,411 | A * | 2/2000 | Richardson | 52/204.51 |
| 6,055,783 | A * | 5/2000 | Guhl et al. | 52/204.62 |
| 6,115,989 | A | 9/2000 | Boone et al. | |
| 6,393,768 | B1 * | 5/2002 | Roche et al. | 49/506 |
| 6,401,399 | B1 * | 6/2002 | Roche et al. | 49/501 |
| 6,401,428 | B1 | 6/2002 | Glover et al. | |
| 6,463,706 | B1 * | 10/2002 | Guhl et al. | 52/204.62 |
| 6,868,648 | B2 * | 3/2005 | Glover et al. | 52/786.1 |
| 6,886,297 | B1 * | 5/2005 | Crandell | 52/172 |
| 6,889,480 | B2 * | 5/2005 | Guhl et al. | 52/786.1 |
| 7,293,391 | B2 * | 11/2007 | Guhl et al. | 52/204.593 |
| 7,490,445 | B2 * | 2/2009 | Steffek et al. | 52/456 |
| 2002/0056184 | A1 * | 5/2002 | Richardson et al. | 29/458 |
| 2002/0078654 | A1 * | 6/2002 | Richardson et al. | 52/656.9 |
| 2004/0172892 | A1 * | 9/2004 | Cremaschi | 52/171.3 |
| 2004/0231255 | A1 * | 11/2004 | Silverman | 52/204.6 |
| 2005/0028459 | A1 * | 2/2005 | Crandell et al. | 52/204.5 |
| 2005/0028460 | A1 * | 2/2005 | Steffek et al. | 52/204.5 |

FOREIGN PATENT DOCUMENTS

| | | | |
|---|---|---|---|
| JP | 2146488 | A | 6/1990 |
| JP | 4143576 | A | 5/1992 |
| JP | 2004069114 | A | 3/2004 |
| WO | 9318266 | A | 9/1993 |
| WO | 9945331 | A | 9/1999 |

OTHER PUBLICATIONS

Machine Translation corresponding to JP 4143576.
Machine Translation corresponding to JP 2004-069114.

* cited by examiner

FRAME JOINT
REAR VIEW

FRAME JOINT
FRONT VIEW

ISOMETRIC VIEW
REAR OF JOINT

CROSS SECTION

INSULATED PANELS

BACKGROUND

The present invention relates to improvements in insulated glass door and window structures and more particularly relates to an apparatus and method for eliminating or reducing condensation on the external face of such glass doors and the internal face of window structures. More particularly the present invention relates to improvements in the structure of insulated glass door/window structures such as are used in connection with insulated glazed windows (for use in both thermal and sound insulation applications) and refrigeration, and particularly in industrial and commercial refrigeration. The invention also relates to improvements in the economics of manufacture of insulated glass doors and windows. Although the invention will primarily be described with reference to its application in glass doors and particularly triple glazed doors used in such applications as refrigeration, it will be appreciated by persons skilled in the art that the invention has applications in other areas such as in windows and any structure which utilizes glass and particularly though not exclusively double or triple glazing.

PRIOR ART

In industrial and commercial refrigeration, and particularly refrigeration cabinets employed at points of sale and in a variety of establishments, double and/or triple glazed doors are used to insulate the refrigerated contents.

In some glass door structures, for example those in refrigerators, freezers, and the like, where a temperature differing substantially from that of the surrounding atmosphere is to be maintained within a storage compartment, an electrical current and metallic film is employed heating the door frame and outer glass pane in an effort to eliminate condensation and provide clear visibility to the goods contained.

Such conventional glass doors demand not only electrical heating themselves but, due to heat transfer, require additional energy in order to maintain internal refrigeration.

In addition, conventional insulated glass doors comprise parallel panes of glass affixed with spacer bars to form one complete insulated glass unit. This insulated glass unit is then enclosed within a metal or composite structural peripheral door-frame in order to complete the construction of the insulated glass door. The heating apparatuses required to maintain the door panels and door-frame at an optimum temperature add to the cost of the doors and fridge/freezer overall, complicate the construction of the door panels and door-frame, require additional circuitry, and add to the running costs of the fridge/freezer as well as the air conditioning generally employed.

There has been a long felt want in the industry to provide a more efficient and economic means to reduce or eliminate condensation in or on a fridge/freezer door and particularly on those doors having double/triple glazing.

INVENTION

The present invention provides improvements in the structure of insulated glass door structures such as are used in connection with refrigeration and particularly in industrial and commercial refrigeration wherein means are provided to reduce or eliminate condensation on glass and door-frame surfaces. Glass surfaces of such fridge/freezer doors are required to remain clear so that a consumer can inspect the contents of the fridge/freezer.

It will be appreciated by persons skilled in the art that, while the invention to be described herein is open to various variations and modifications, the illustrated embodiments set out herein are non-limiting. It should therefore be understood that the embodiments of the drawings are merely examples of implementation of the invention. There are a variety of embodiments and alternative constructions and equivalents falling within the scope of the invention.

The invention to be described below in its application to a fridge/freezer cabinet door can also be adapted in various applications wherein a door or window or the like separate a region of low temperature relatively dry air from a region having higher temperature and high relative humidity. In the latter case the panel according to the invention may be used to prevent condensation which would normally occur on an outer surface where the temperature on one side is low enough and is transmitted to the other side to cause condensation.

It is one object of the invention to provide means that reduces or eliminates condensation on glass doors of a refrigerator/freezer but without the need for electrical heating of glass surfaces and door-frame comprising the door.

It is another object of the invention to provide means that reduce/eliminate condensation on glass surfaces and door-frame of a refrigerator/freezer and which substantially reduces operating and manufacturing costs.

It is another object of the invention to provide mechanical means that reduce/eliminate condensation on glass doors of a refrigerator/freezer and obviates the need for electrical heating of glass surfaces and door-frame comprising the door.

It is a further object of the invention to provide an alternative means for insulation of double/triple glazed structures such as but not limited to windows and doors and to reduce or eliminate unwanted condensation on such structures.

It is a further object of the invention to provide mechanical means that reduce/eliminate condensation on glass surfaces and door-frames of a refrigerator/freezer but without the costs and maintenance associated with the electrical heating of glass surfaces and door-frames of fridge/freezer doors.

It is a further object of the invention to provide an alternative means for the construction of glazed fridge/freezer doors in which glazed panels are set into a prefabricated frame without the need for mounting an insulated glass unit into an enclosed metal, composite, or thermal plastics frame.

It is a further object of the invention to provide an alternative means for the construction of glazed fridge/freezer doors without the need for manufacturing an insulated glass unit.

It is a further object of the invention to provide an alternative means for the construction of glazed fridge/freezer doors without using steel fasteners and the like to fasten the door-frame.

The present invention seeks to provide a novel alternative to the known methods of reducing/eliminating condensation on glass refrigerator/freezer doors without the need for electrical heating elements.

The present invention also seeks to provide a novel alternative to the known methods of insulating and manufacturing double/triple-glazed windows.

In a broad form of an apparatus aspect the present invention provides a substantially planar insulating panel comprising:

a frame defining a periphery of the panel;

a first wall retained by the frame and a second wall opposing the first wall and together with the first wall and the frame defining an enclosed internal space of the panel;

at least one intermediate insulating wall disposed in the internal space intermediate the first and second wall members and which creates a first enclosed space in the internal space between the insulating wall and the first wall and a second enclosed space in the internal space between the insulating wall and the second wall, wherein the insulating wall insulates the first wall from the second wall;

the frame comprising an extruded profile;

the profile having a series of spaced mounting surfaces which receive and retain the walls, the mounting surfaces arranged in a cascading series such that the areas of the walls diminish sequentially in one direction from one side of the panel to the other and the walls are sequentially spaced apart from each other. The cascading series of mounting surfaces providing the frame with a multi-layered series of spaces in the frame between the walls which progressively diminish in area in said one direction.

It is preferred that the frame is a unitary structure and the extruded profile of the frame is miter jointed to form a continuous profile having no mechanical start or end point. Preferably the miter joints are welded.

The frame profile in section may have at least one cavity for the retention of a moisture-absorbent desiccant material. Advantageously, the cavity may be sealed prior to the welding of the frame. Similarly, the frame profile in elevation may have perforations located between the mounting surfaces such that the cavities are in communication with the first and/or second enclosed spaces, such that the perforations allow for the absorption of moisture only from an apposing enclosed space. The frame profile in section also may have cavities adapted to provide insulation.

The walls, preferably, are affixed to the mounting surfaces using a rigid or semi-rigid adhesive which has either ultraviolet-setting or thermo-setting properties. In addition, the mounting surfaces may have one or more recesses which act as traps for any excess adhesive used in affixing the walls.

Preferably the first and/or second enclosed spaces are sealed and filled with air, argon gas, foam or another insulating material.

The frame may contain a gasket-retaining groove adapted to retain a magnetized flexible sealing gasket which provides an airtight seal between the panel and an article to which the panel is fitted. Similarly, the frame may include a keyway for insertion and mounting of a hinge.

According to a preferred embodiment the frame is formed of a thermal plastics material and the first and second walls comprise glass panes that define the internal space. The planar insulating wall member is preferably a transparent thermal plastics material mounted midway between the glass panes.

The frame may be formed of a semi-rigid thermal plastics material and the walls of glass or plastic panes such that the panes provide rigidity to the panel structure.

Utilising thermal plastics material in the frame allows the miter joints to be formed by thermal mirror welding which is a simple, quick and convenient process that results in a strong joint.

Preferably the walls are transparent and may be glass, Perspex™, thermal plastics or the like. According to one embodiment, plastic extrusions may be used to provide the frame that also acts as glass panel spacers and mounting surfaces.

In another broad form of a method aspect, the present invention provides a method for constructing a substantially planar insulating panel including a frame in which is disposed two walls defining an internal space; the internal space including at least one internal insulating wall which insulates the two outer walls thereby reducing or eliminating condensation on the outer walls and frame; the method comprising the steps of:

a) providing two glass walls of a predetermined size, the first, outer wall having an area smaller than the second, inner wall;

b) providing at least one thermal plastic insulating wall having an area larger than the first wall and smaller than the second wall;

c) constructing a frame having a series of spaced mounting surfaces which receive and retain the walls, the mounting surfaces arranged in a cascading series such that the areas of the walls and the spaces in the frame between the walls diminish sequentially in one direction from one side of the panel to the other and the walls are sequentially spaced apart from each other and a the frame having at least one chamber with perforations in an inner wall of the frame between the mounting surfaces containing desiccant moisture absorption material, the at least one chamber sealed from the internal space except for perforations in the inner wall of the frame between the mounting surfaces to allow for the absorption of moisture from only an apposing enclosed space;

d) fitting the first wall to an inner mounting surface of the frame;

e) fitting the insulating member to a second mounting surface on the frame in a central position relative to the outside surfaces of the frame; and f) fitting the second wall to a third mounting surface of the frame such that the walls are in opposing relationship and define the internal space housing the insulating member.

The method may comprise the further step of placing the insulating wall member at an optimum spacing and equidistant from the first and second walls.

Throughout the specification, a reference to a door may be taken as a reference to a window as the context allows, and a reference to a window may be taken to include a door as the context allows. Although the invention will be described with primary reference to a door, it will be appreciated by persons skilled in the art that the panel according to the invention may be used in a variety of applications to reduce/eliminate unwanted condensation on one or other of outer walls of the panel and door-frame.

DETAILED DESCRIPTION

The present invention will now be described in more detail according to preferred but non-limiting embodiment and with reference to the accompanying illustrations wherein.

Figure 1:
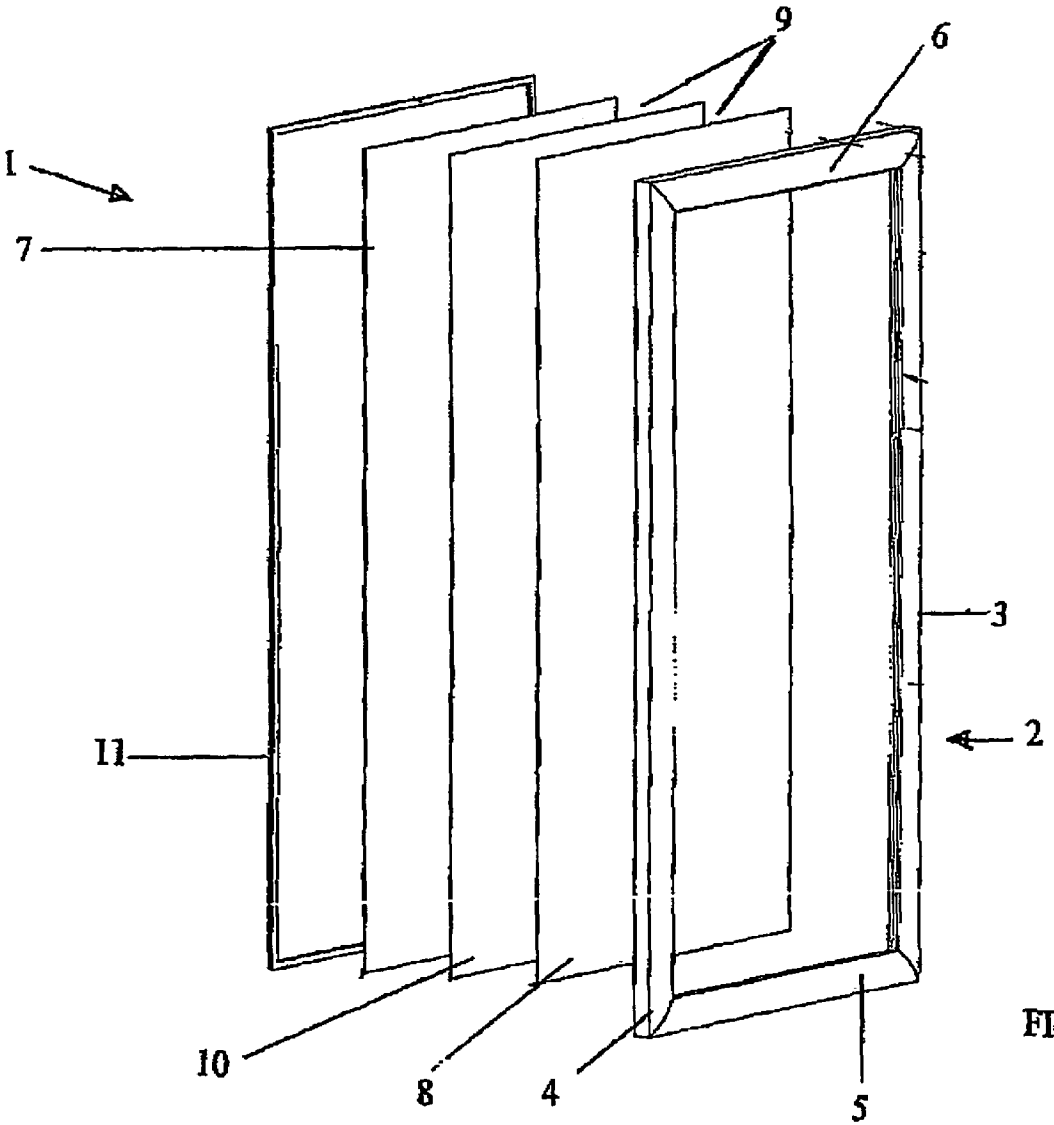
FIG. 1 shows an exploded perspective view of a door panel according to one embodiment.

Referring to FIG. 1, there is shown an exploded perspective view of a door panel 1 according to one embodiment. Door panel 1 comprises a peripheral frame 2 having long sides 3 and 4 and short sides 5 and 6. Fitted inside frame 2 are glass panels 7 and 8 which are disposed in opposing relationship and define an internal space 9 there between. Internal space 9 receives and retains therein an insulating member 10 which is preferably spaced so it is equidistant from panels 7 and 8 so that panels 7 and 8 are mutually isolated from each other. Panel 1 further comprises a magnetic gasket 11 which is fixed in a gasket groove (see FIG. 3).

Figure 2:
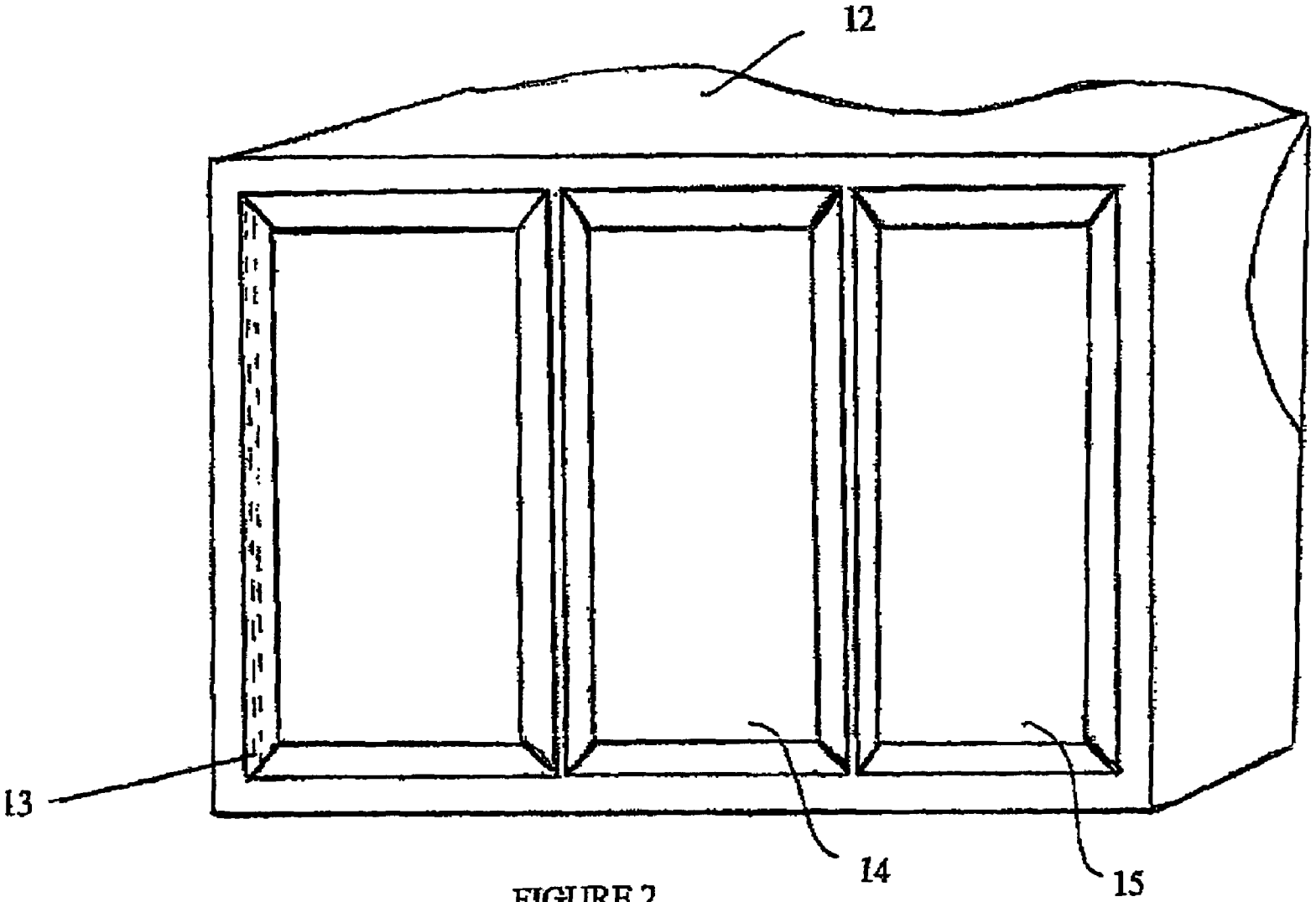
FIG. 2 shows a front elevation of a refrigeration unit having three doors according to one embodiment.

FIG. 2 shows a front elevation of a refrigeration unit 12 having three doors 13, 14 and 15 constructed in accordance with the panel 1 arrangement described in FIG. 1. Fridge/freezer unit 12 is typically an industrial fridge/freezer having a cooled interior and transparent doors so that the contents of the fridge/freezer may be viewed from the outside. In the past the problem has been condensation forming on the outer surfaces of the doors as one side is exposed to refrigeration temperature and the other side is exposed to ambient room temperature. This inevitably leads to potential condensation on the outside of the glass panes and door frame thus obscuring the fridge contents. Doors 13, 14 and 15 have an insulating member corresponding to insulation member 10 as described with reference to FIG. 1.

Figure 3:
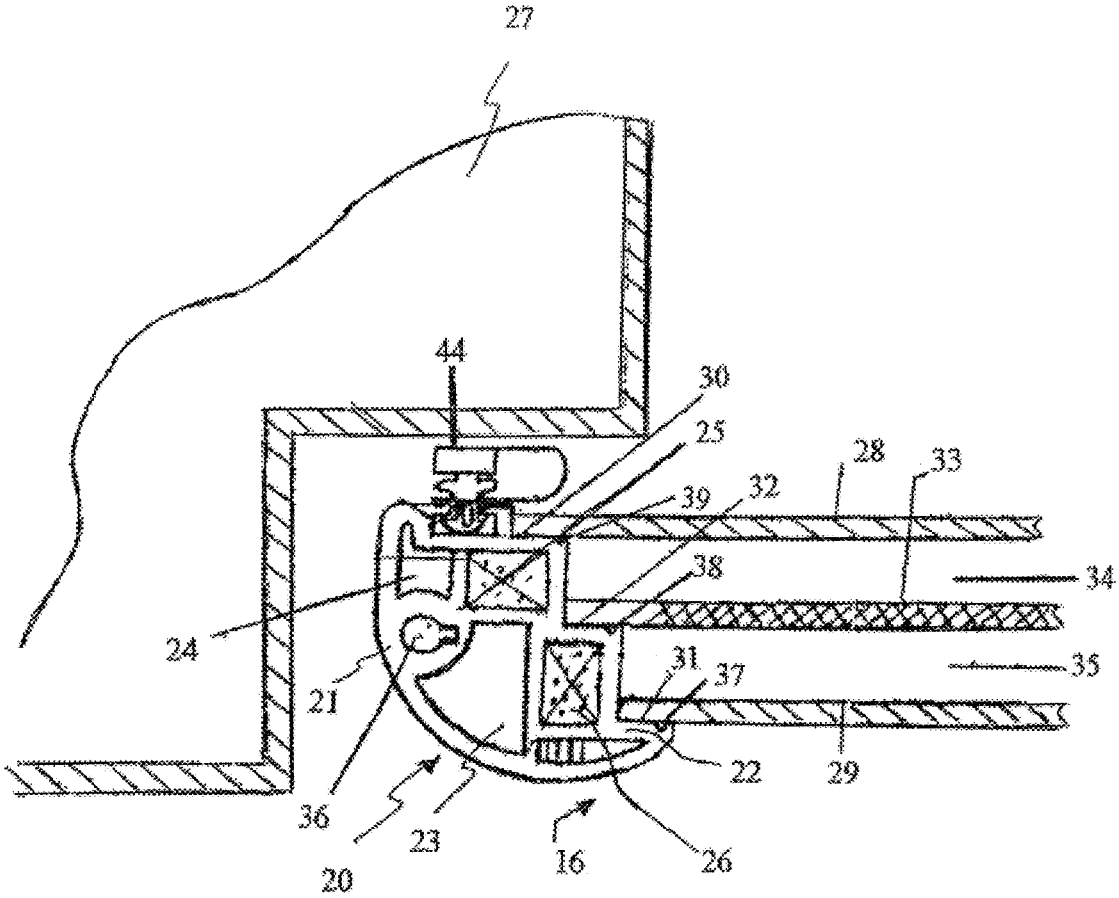
FIG. 3 is an enlarged cross sectional view of an abbreviated frame extrusion including fitted glass panels and an intermediate insulating panel.

FIG. 3 is an enlarged cross sectional view of an abbreviated frame 16 including an extrusion including fitted glass panels and an intermediate insulating panel. Extrusion 20, which is manufactured from thermal plastics, comprises an outer wall 21 and inner wall 22 which define internal spaces 23, 24, 25 and 26. Preferably a plastics extrusion is provided forming a panel which functions as either a window or door. The plastics frame extrusion 20 is cut and welded to suit the refrigeration unit 27 to which the door/window will be attached. Glass panes 28 and 29 are mounted on the respective mounting surfaces 30 and 31. Also fitted to extrusion 20 via surface 32 is a clear rigid thermal plastics insulating member 33 mounted midway between glass panes 28 and 29. Glass panes 28 and 29 and insulating member 33 are attached to their respective mounting surfaces using a rigid adhesive. Glass panels 28 and 29 and plastics insulating member 33 are spaced to provide optimum insulation with air and/or argon gas filled cavities 34 and 35. Additional features in the plastics extrusion 20 include a hinge and torsion bar mounting point 36 and excess rigid adhesive traps 37, 38 and 39. A magnetised flexible gasket 44 is inserted into the gasket-retaining groove 45 providing an airtight seal between the insulated glass door and the door fascia of the refrigerator/freezer unit 27.

Figure 4:
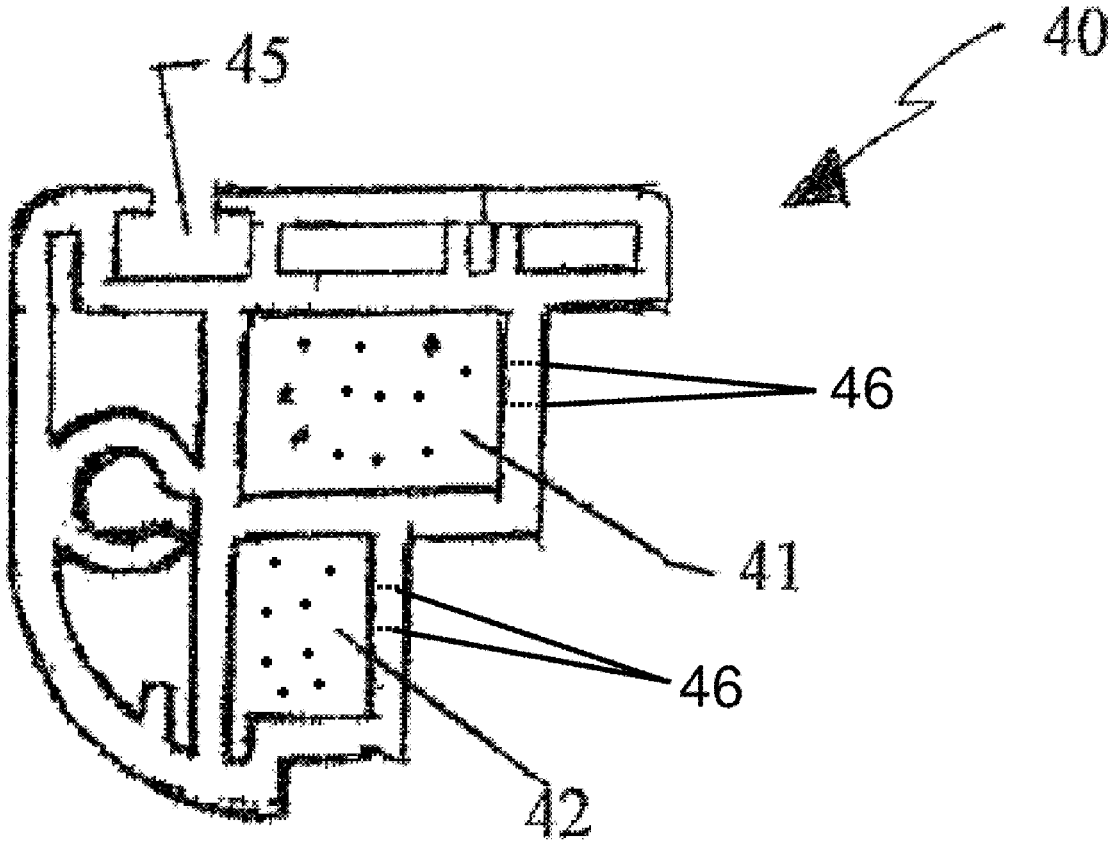
FIG. 4 is a cross sectional diagram of a frame extrusion for an insulated glass door according to one embodiment.

FIG. 4 is a cross sectional diagram of a frame extrusion 40 for an insulated glass door according to one embodiment. The air and/or argon gas is inserted via latex valves (not shown) located in a horizontal door-frame formed by extrusion 40. Desiccant chambers 41 and 42, formed in the plastics extrusion 40, are filled with desiccant moisture absorption granules in the vertical frame sections and sealed using plastic caps (see FIG. 3) prior to welding. The extrusion 40 may have perforations 46 located in the inner wall of the frame between its mounting surfaces such that desiccant chambers 41 and 42 are in communication with internal spaces formed between the panes and insulating member, such that the perforations allow for the absorption of moisture only from an apposing enclosed space.

Figure 5:
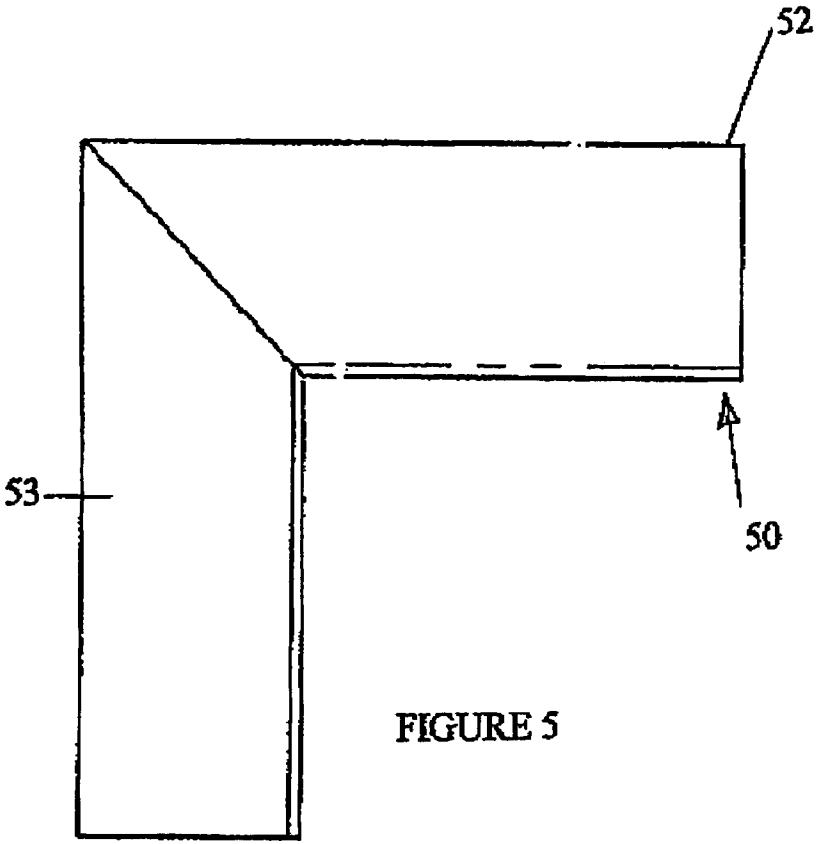
FIG. 5 shows a part elevation view of a door panel frame from a front view.

FIG. 5 shows a part elevation view of a door panel frame 50 from a front view. Panel 50 includes an upper frame member 52 and side member 53.

Figure 6:
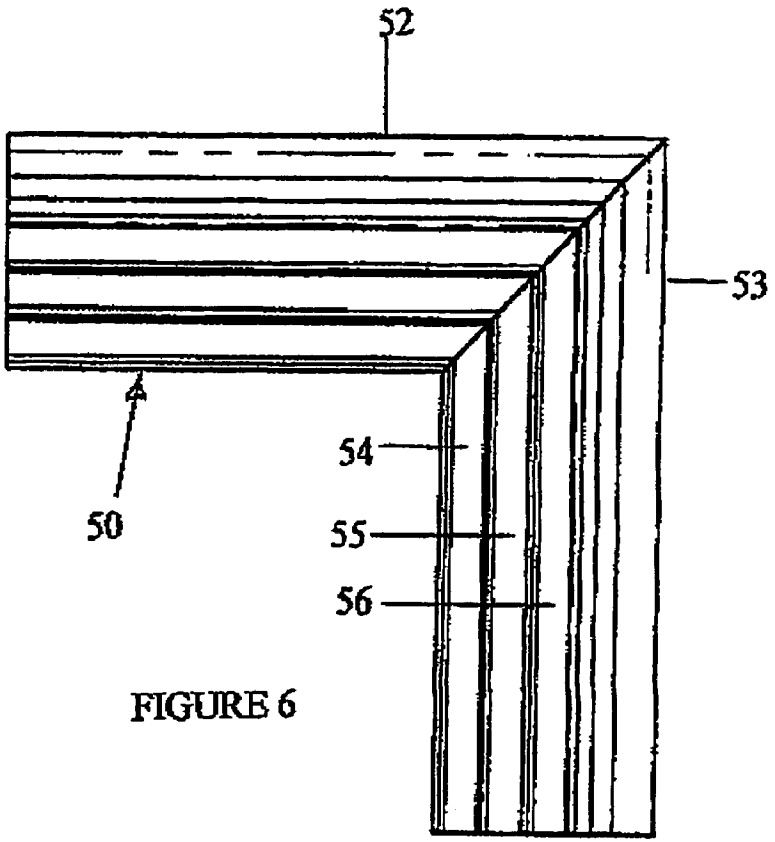
FIG. 6 shows a part elevation view of a door panel frame from a rear view.

FIG. 6 shows, from a rear (reverse side) view, an elevation view of the part door panel frame 50 comprising upper frame member 52 and side frame member 53. Frame 50, which is formed from a preferably plastics extrusion, is adapted with three shoulder regions 54, 55 and 56 which define recesses which each receive and retain panes 57, 58 and 59 as shown in FIG. 7.

Figure 7:
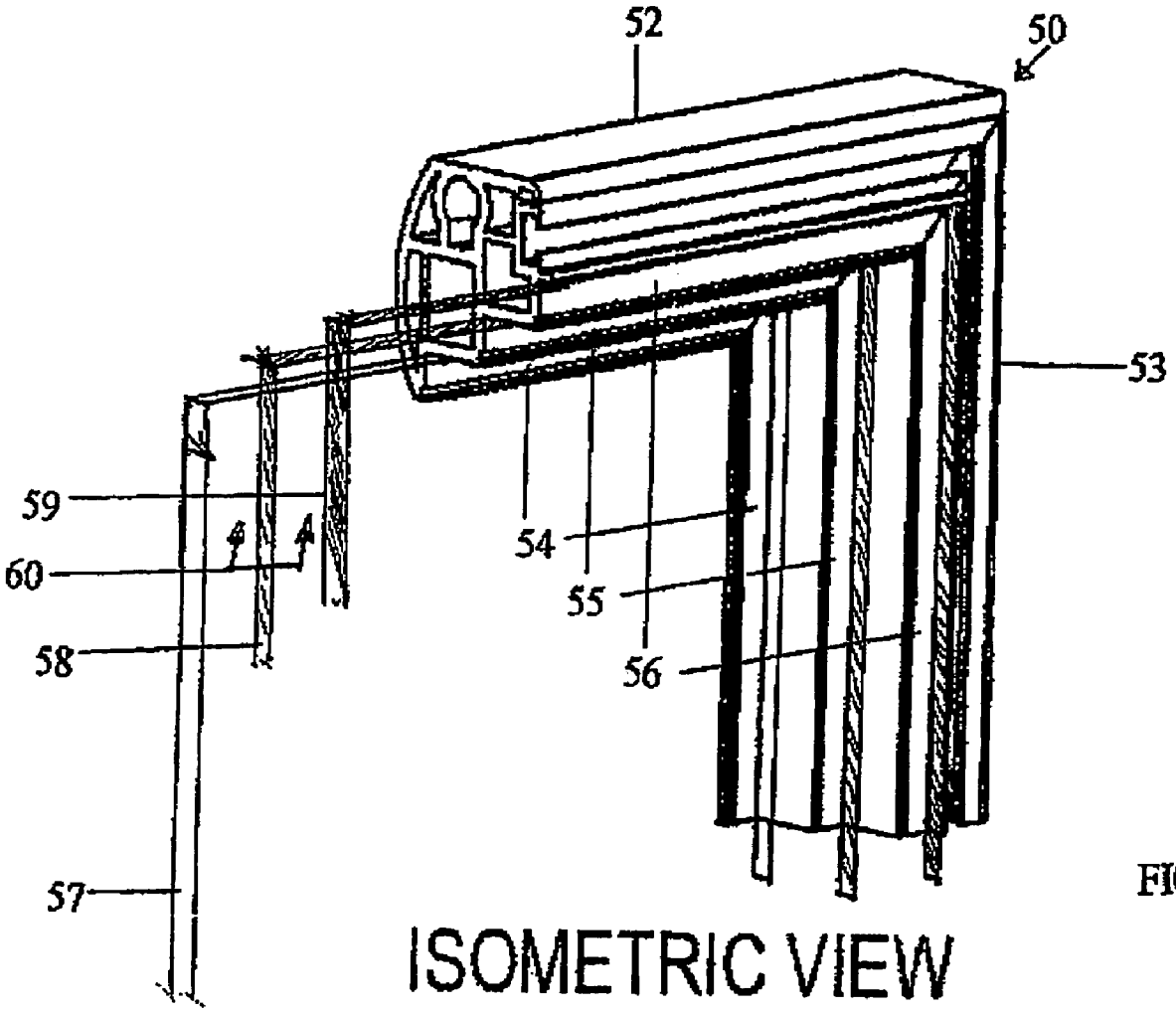
FIG. 7 shows an isometric view of a section of a panel with panes fitted according to a preferred embodiment.

FIG. 7 shows an isometric view of a section of a panel with panes fitted according to a preferred embodiment. According to one embodiment of a method aspect, a typical panel may be constructed in accordance with a method to be described with reference to FIG. 7.

Peripheral frame 50 may be constructed from a metal or plastics material. Preferably the frame material is an extruded plastics. Typically, a frame will comprise upper member 52 and lower member 53 formed from an extrusion and which includes recesses which form bearing shoulders 54, 55 and 56 which respectively receive panes 57, 58 and 59.

Pane 57 forms an outer door surface and pane 59 an inner door surface which each define an internal space 60. Pane 58 locates on shoulder 55 in inner space 60 and provides an insulation of panes 57 and 59 to prevent condensation.

The preferred method comprises the steps of:

a) providing two panes 57 and 59 of a predetermined size;
b) providing an insulating member 58;
c) constructing a frame 50 from a thermal plastics extrusion having a profile so that the completed frame includes three shoulder regions 54, 55 and 56;
d) the first pane 57 is fitted so that its periphery engages shoulder recess 54, (Preferably the pane is glued peripherally to shoulder 54);
e) next, insulating member 58 is glued to shoulder recess 55 which is disposed in a central position relative to outside surfaces of the door panel;
f) finally, pane 59 is seated on and glued to shoulder 56 to seal internal space 60, (Pane 57 forms an outer surface of the panel 50);

wherein the panes are arranged so that the first and second panes 57 and 59 define an internal space 60 divided by the insulating panel 58, which is located intermediate the first and second panes. Preferably the panes are transparent glass.

Figure 8:
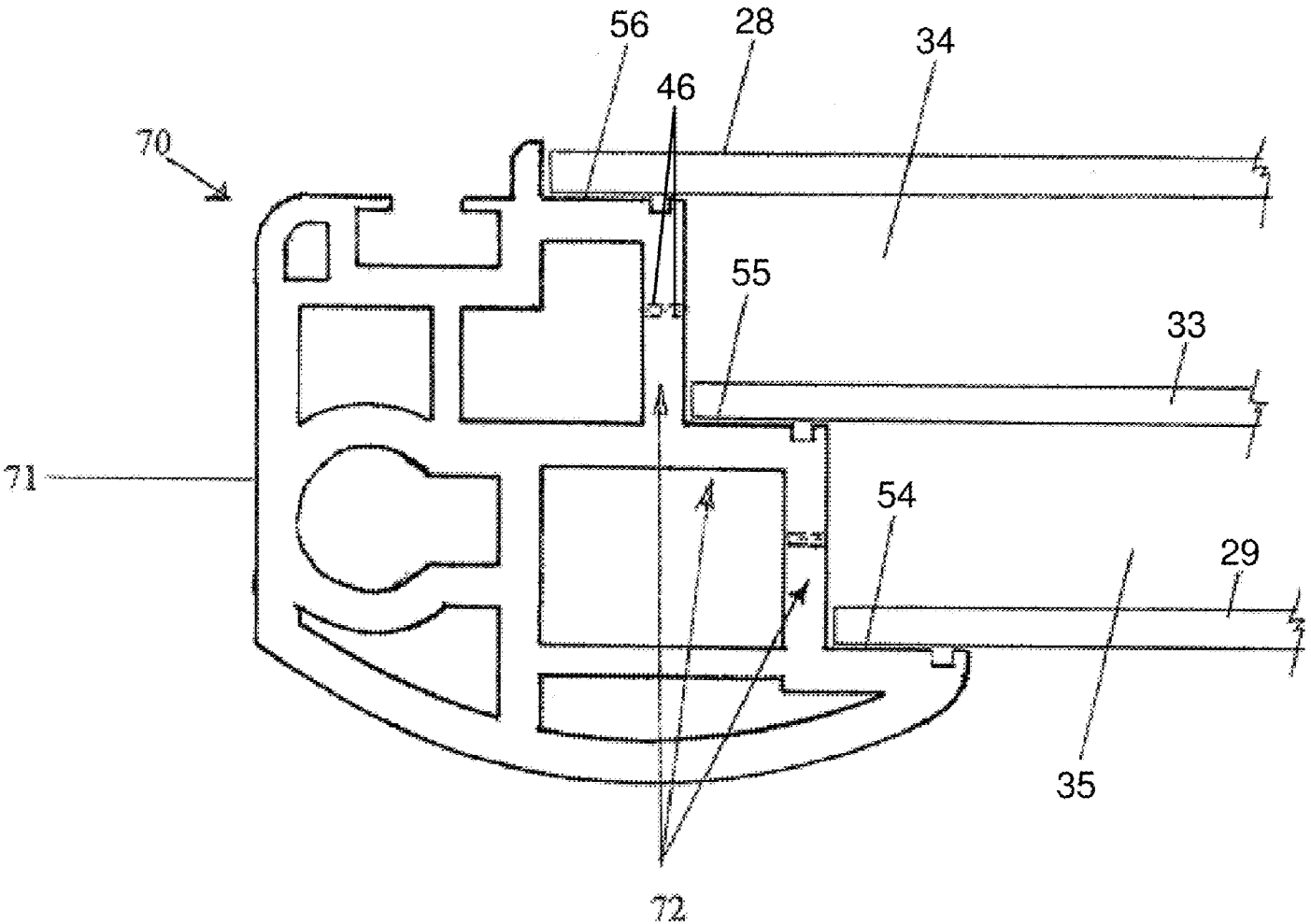
FIG. 8 shows an enlarged cross sectional view of an extrusion used in a door-frame according to one embodiment.

FIG. 8 shows an enlarged cross sectional view of an abbreviated frame extrusion 70 used in a door-frame according to one embodiment. Frame extrusion 70, which is preferably manufactured from thermal plastics, comprises an outer wall 71 and inner wall 72. Inner wall 72 defines internal spaces 34 and 35. Frame extrusion profile 70 provides an outer panel structure which may be a window, door or the like. The plastics frame extrusion 70 is cut and welded to suit its particular application and in a preferred embodiment is adapted as a fridge or freezer door. Panes 28 and 29 are preferably manufactured from glass and are mounted on the respective mounting surfaces 56 and 54. Also fitted to extrusion 70 via surface 55 is a clear rigid thermal plastics insulating member 33 mounted intermediate glass panes 28 and 29. Glass panes 28 and 29 and insulating member 33 are attached to their respective mounting surfaces 56, 54, and 55 using a suitable rigid sealing adhesive. Glass panes 28 and 29 and plastics insulating member 33 are spaced to provide optimum insulation with air and/or argon gas filled cavities 34 and 35. Additional features in the plastics extrusion 70 include a hinge and torsion bar keyway (not shown) for mounting purposes. Extrusion profile 70 may also include perforations 46 located between the mounting surfaces as described in FIG. 4 for communicating with cavities defined by inner wall 72.

Figure 9:
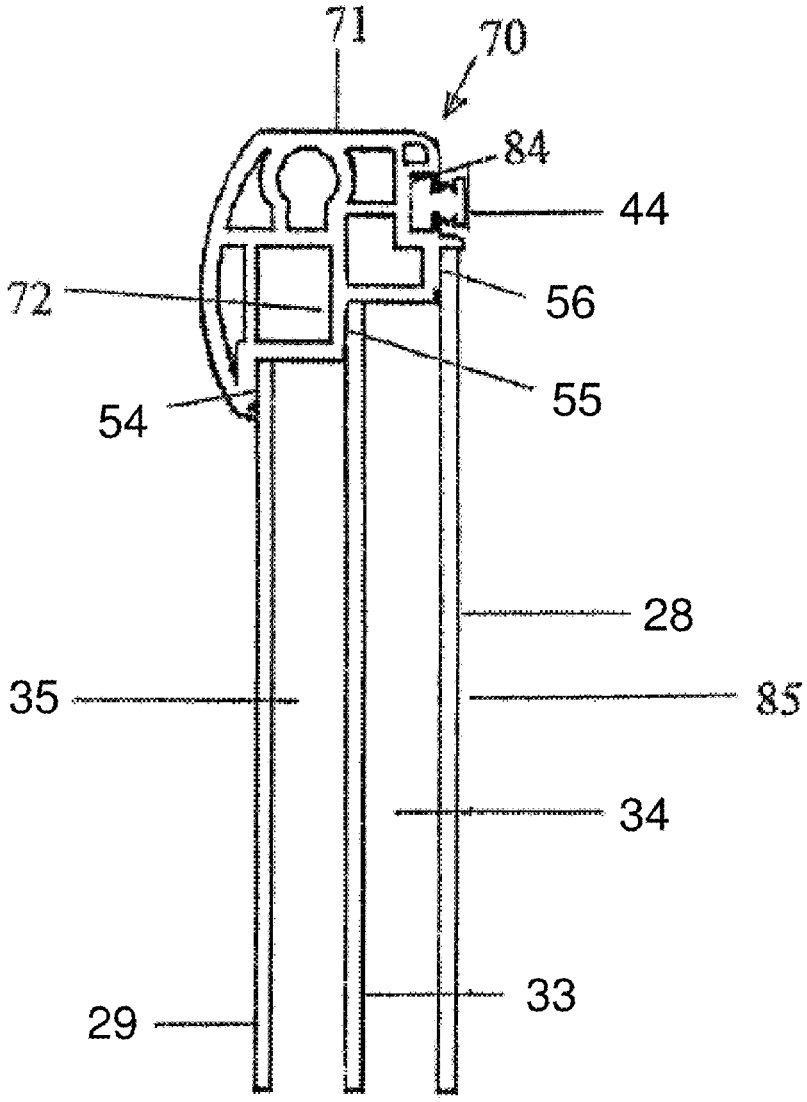
FIG. 9 shows a cross sectional-view of a section of a panel with panes fitted.

FIG. 9 shows a half section of the door panel 70 of FIG. 8 constructed in accordance with the invention and with corresponding numbering. Panel 70 is shown including a magnetic flexible gasket 44 inserted into the gasket retaining groove 84 providing an airtight seal between the insulated glass door and the door fascia of the refrigerator/freezer unit 85.

From the foregoing, it can be seen that the insulated door/window assembly of the present invention has a modern substantially all glass front appearance but increasing the efficiency and strength of conventional insulated doors and windows to which the industry has been accustomed. Since the door/window assembly requires fewer components such that it comprises a single unit, structural instability causing sag is eliminated, manufacturing costs are greatly reduced, and operational costs are substantially lowered with the removal of electrical heating.

Manufacture of a panel in accordance with the invention results in potentially a 60% parts saving and 50% labour saving by comparison with a known typically available commercial fridge or freezer door having a heating element apparatus. Panels or doors made in accordance with the invention do not require any ancillary heating elements or associated heating apparatuses, nor the associated materials and labour. The method of construction allows the panel to function so that condensation is eliminated without the use of heating elements. Consequently, since no heating elements are required, energy savings are estimated to be up to 55% in comparison to a panel or door of similar proportions requiring heating elements.

One advantage of the present invention is that it obviates the need for spacer bars previously used to space apart glass panels prior to final enclosure in a peripheral frame. In the past a panel was constructed by first setting the panes in layers and keeping them spaced apart by spacer bars which set a predetermined distance between the panels and formed an insulated glass unit. A metal frame was fitted around the insulated glass unit to complete the panel. This makes panels relatively heavy and their construction labor intensive. The panels according to the invention do not require spacer bars or the construction of an insulated glass unit and are lightweight in comparison to the known panels of a similar size. The preferred frame is manufactured from extruded plastics contributing significantly to weight and component reduction.

It will be recognized by persons skilled in the art that numerous variations and modifications may be made to the invention as broadly described herein without departing from the spirit and scope of the invention.

The claims defining the invention are as follows:

1. A substantially planar insulating panel comprising:

a rigid frame defining a continuous periphery of the panel;

a first glass wall retained by the frame and a second glass wall spaced from and opposing the first wall and together with the first wall and the frame defining an enclosed internal space of the panel; and at least one intermediate thermal plastic insulating wall disposed in the internal space spaced from and intermediate the first and second wall members to create a first enclosed space in the internal space between the intermediate insulating wall and the first wall and a second enclosed space in the internal space between the intermediate insulating wall and the second wall, wherein the intermediate insulating wall insulates the first wall from the second wall;

wherein the frame forms a series of parallel, spaced apart mounting surfaces arranged about an inner periphery of the frame in a stepwise manner connected by an inner wall of the frame, the mounting surfaces receiving and retaining the walls thereon and arranged in a cascading series such that the areas of the walls diminish sequentially in one direction from one side of the panel to the other and the walls are sequentially spaced apart from each other, the parallel, spaced apart mounting surfaces enabling walls with sequentially larger areas to be inserted into the frame one after another, and the frame further includes a first sealed chamber formed therein comprising a portion of the inner wall directly adjacent to the first enclosed space and a second sealed chamber formed therein comprising a portion of the inner wall directly adjacent to the second enclosed space, the first and second chambers containing desiccant moisture absorption material and each having perforations in the inner wall of the frame between the mounting surfaces to allow for the absorption of moisture from only the directly adjacent enclosed space.

2. A panel according to claim 1 wherein the frame is a unitary structure formed of a series of linear segments which are miter jointed to form a continuous profile having no mechanical start or end point.

3. A panel according to claim 2 wherein the miter joints in the frame are welded.

4. A panel according to claim 1 in which the frame profile in section has cavities adapted to provide insulation.

5. A panel according to claim 4 in which the walls are affixed to the mounting surfaces using a rigid or semi-rigid adhesive which has either ultraviolet-setting or thermo-setting properties.

6. A panel according to claim 5 in which the mounting surfaces have one or more recesses which act as traps for any excess adhesive used in affixing the walls.

7. A panel according to claim 6 in which the first and/or second enclosed spaces are sealed and filled with air, argon gas, foam or another insulating material.

8. A panel according the claim 1 in which the frame includes a gasket-retaining groove retaining a magnetized flexible sealing gasket which provides an airtight seal between the panel and an article to which the panel is fitted.

9. A panel according to claim 1 in which the frame profile includes a keyway for insertion and mounting of a hinge.

10. A panel according to claim 1 in which the frame is formed from a thermal plastics material.

11. A method for constructing a substantially planar insulating panel including a frame in which is disposed two walls defining an internal space; the internal space including at least one internal insulating wall which divides the internal space into a first enclosed space and a second enclosed space and insulates the two outer walls thereby reducing or eliminating condensation on the outer walls of the frame; the method comprising the steps of:

(a) providing two glass walls of a predetermined size, a first, outer wall having an area smaller than a second, inner wall;

(b) providing at least one thermal plastic insulating wall member having an area that is larger than the first wall and smaller than the second wall;

(c) providing peripheral frame segments having a series of spaced mounting surfaces which receive and retain the walls and insulating wall member and a least one frame segment having a first chamber formed therein comprising a portion of an inner wall directly adjacent to the first enclosed space and a second chamber formed therein comprising a portion of an inner wall directly adjacent to the second enclosed space with perforations in the inner wall of the frame between the mounting surfaces, the mounting surfaces arranged in a cascading series such that the areas of the walls diminish sequentially in one direction from one side of the panel to the other and the walls are sequentially spaced apart from each other;

(d) inserting a desiccant material into the first and second chamber;

(e) sealing the first and second chamber except for the perforations;

(f) attaching the peripheral frame segments together to form a continuous peripheral frame;

(g) fitting the first wall to an inner mounting surfaces of the frame;

(h) fitting the at least one insulating wall member to a second mounting surface on the frame in a central position relative to the outside surfaces of the frame; and (i) fitting the second wall to a third mounting surface of the frame such that the glass walls are in opposing relationship and define an internal space housing the insulating member.

12. A method according to claim 11 comprising the further step of placing the insulating wall member at an optimum spacing and equidistant from the first and second walls.

13. The method according to claim 11, wherein the mounting surfaces are parallel and spaced apart from each other and connected by an inner wall of the frame.

14. The method according to claim 11, wherein the frame comprises a series of linear segments miter jointed together to form the continuous peripheral frame prior to the fitting of the walls to their respective mounting surfaces.

15. The method according to claim 11, wherein fitting the walls to their respective mounting surfaces comprises introducing an adhesive between the mounting surface and corresponding wall.

16. A substantially planar insulating panel comprising:

a frame defining a periphery of the panel;

a first glass wall retained by the frame and a second glass wall opposing the first wall and together with the first wall and the frame defining an enclosed internal space of the panel;

at least one intermediate thermal plastic insulating wall disposed in the internal space intermediate the first and second walls and which creates a first enclosed space in the internal space between the insulating wall and the first wall and a second enclosed space in the internal space between the insulating wall and the second wall, wherein the insulating wall insulates the first wall from the second wall;

the frame comprising an extruded profile;

the profile having a series of spaced mounting surfaces which receive and retain the walls thereon, the mounting surfaces arranged in a cascading series such that the areas of the walls diminish sequentially in one direction from one side of the panel to the other and the walls are sequentially spaced apart from each other, the profile further comprising at least one chamber formed therein containing desiccant moisture absorption material, the at least one chamber sealed from the first and second enclosed spaces except for perforations in an inner wall of the frame between the mounting surfaces to allow for the absorption of moisture from only an apposing enclosed space, the cascading series of mounting surfaces also providing the frame with a multi-layered series of openings in the frame which progressively diminish in area in said one direction, which series of openings in the frame enable a procession of progressively larger of said walls, during assembly of the panel, to be inserted one after the other each directly onto one after another of said cascading series of mounting surfaces.

17. A method for constructing a substantially planar insulating panel including a frame in which is disposed two outer walls defining an internal space therebetween; the internal space including at least one internal insulating wall which insulates the two outer walls thereby reducing or eliminating condensation on the outer walls of the frame; the method comprising the steps of:

(a) providing two glass outer walls of a predetermined size;

(b) providing at least one thermal plastic insulating wall;

(c) constructing a frame from extruded frame segments having a series of spaced mounting surfaces which are adapted to receive and retain the walls, the mounting surfaces arranged in a cascading series such that, when the walls are in the frame, the areas of the walls diminish sequentially in one direction from one side of the panel to the other and the walls are sequentially spaced apart from each other, the cascading series of mounting surfaces also providing the frame with a multi-layered series of openings in the frame which progressively diminish in area in said one direction, at least one of the frame segments having at least one chamber formed therein containing desiccant moisture absorption material, the at least one chamber sealed from the internal space except for perforations in an inner wall of the frame segment between the mounting surfaces to allow for the absorption of moisture from only an apposing enclosed space; and (d) inserting through the openings in the frame a procession of progressively larger of said walls one after the other each directly onto one after another of said cascading series of mounting surfaces as follows:

(e) fitting the first outer wall to an inner mounting surface of the frame;

(f) fitting the insulating wall to a second mounting surface on the frame in a central position relative to the outside surfaces of the frame; and (g) fitting the second outer wall to a third mounting surface of the frame such that the first and second outer walls are in opposing relationship and define the internal space that houses therein the at least one insulating wall.

* * * * *